US005493732A

United States Patent [19]

Fawkes

[11] Patent Number: 5,493,732

[45] Date of Patent: Feb. 27, 1996

[54] FOLDABLE, BILLED KERCHIEF

[76] Inventor: Margaret A. Fawkes, 13209 Norwood Rd., Raleigh, N.C. 27614

[21] Appl. No.: 266,192

[22] Filed: Jun. 27, 1994

[51] Int. Cl.[6] ..... A42B 1/20

[52] U.S. Cl. ..... 2/195.1; 2/207

[58] Field of Search ..... 2/171, 172, 174, 2/181, 195.1, 207, 209.11, 209.12, 200.1, 10, 11, 12, 15, 171.03

[56] References Cited

U.S. PATENT DOCUMENTS

| | | | |
|---|---|---|---|
| 2,005,361 | 6/1935 | Rollins et al. | 2/195.1 |
| 4,549,316 | 10/1985 | Johnson | 2/195.1 |
| 5,253,369 | 10/1993 | Patterson | 2/200.1 |

FOREIGN PATENT DOCUMENTS

| | | | |
|---|---|---|---|
| 965688 | 9/1950 | France | 2/207 |
| 522673 | 6/1940 | United Kingdom | 2/12 |

*Primary Examiner*—Clifford D. Crowder
*Assistant Examiner*—Diana L. Biefeld
*Attorney, Agent, or Firm*—John G. Mills & Associates

[57] ABSTRACT

This invention is a head with a kerchief portion, a forefront portion and a billed portion. The kerchief portion is attached to the forefront portion and the billed portion is attached to the forefront portion along a weakened fold line. Both the forefront portion and the billed portion each include a reenforced central panel and a pair of reenforced side panels connected thereto by weakened fold lines. When worn, the present invention looks like a baseball cap with a kerchief attached. When the bill portion is folded juxtaposed to the forefront portion and the respective side portions are folded back on the central portions, the kerchief can be wrapped thereabout to form a compact folded headwear that can be stored in a small purse, pocket or the like when not in use.

9 Claims, 5 Drawing Sheets

FOLDABLE, BILLED KERCHIEF

FIELD OF THE INVENTION

This invention relates to wearing apparel and more particularly to head wear.

BACKGROUND OF INVENTION

There are many reasons that people use headwear. It can be used to keep the hair out of the face of the user, to prevent groomed hair from becoming ruffled and tangled, it can be used to prevent the sun from bleaching the color from the hair, it can be used to prevent dyed hair from changing color, it can be used to shade the eyes from the sun, and for a myriad of other reasons.

Kerchiefs have long been used, particularly by women, to cover the head. Also kerchiefs can be readily folded for storage in a pocket or purse until needed. Kerchiefs, however, do not protect the face and eyes of the user from the sun.

Various styles and shapes of brims and brimmed hats have been devised over the years to shade the eyes and at least part of the face from direct light such as sunlight. These brims or bills, by necessity, must have some stiffening means to hold their shape and, therefore, are not readily stored in a pocket, purse, or the like when not in use. This forces the user to keep up with the brimmed or billed hat until it is needed or to wear the same whether it is needed not.

Attempts have been made to combine kerchiefs with bills or brims but the articles have not obtained wide acceptance because, among other reasons, they have the inherent storage problem that is encountered by brimmed and billed head gear generally.

Concise Explanation of References

U.S. Pat. No. Des. 135,321 to Harpignies discloses a kerchief type cloth with a bill attached thereto with a drawstring to hold the same in place.

U.S. Pat. No. 5,253,369 to Patterson, Jr. discloses a stiffened visor attached to a triangular shaped piece of cloth as shown in FIG. 8.

U.S. Pat. No. 5,161,260 to Reynolds discloses in FIG. 8 a visor attached to a kerchief-like piece of cloth with a visor encircling the entire head of the user.

U.S. Pat. No. 5,048,128 to Watson, Jr. again discloses a bill attached to a piece of cloth with a tie string that encircles the head of the user.

U.S. Pat. No. 2,089,995 to Dobbs likewise discloses a bill with a cloth member and a tie that encircles the head of the user.

U.S. Pat. Nos. 2,859,448 to Gaichel, 2,735,110 to Baker, 3,376,581 to Gettinger and 2,651,044 to Stankiewicz et al all disclose additional cloth head coverings with attached bills or brims.

U.S. Pat. No. 5,293,646 discloses a kerchief-like protective garment with a bill that attaches by Velcro if desired.

Finally, U.S. Pat. No. 1,646,193 to Farkas is considered of interest in that it discloses a cloth that covers the head of the user with a head encircling band to hold the same in place.

BRIEF DESCRIPTION OF INVENTION

After much research amid study into the above mentioned problems, the present invention has been developed to provide all of the attributes of a kerchief with the additional benefits of a brim or bill while eliminating the storage problems associated with the prior art bills and brims.

The above is accomplished through the provision of a relatively stiff bill that is attached to a forefront along a fold line. This combination gives an eye and face shielding means that will hold its shape and will not flatten the hair above the forehead of the user.

Matching lateral fold lines across opposite sides of the bill and forefront allow the forefront to be folded down on the bill and the outer third of the thus folded bill and forefront to be folded back against the bill so that the kerchief can be wound therearound forming a flat storage configuration that can be readily placed in a pocket or purse. In this folded condition the present invention will even fit in the pocket of a man's dress shirt.

When it is desired to use the present invention, it is simply unrolled, the bill and forefront deployed into normal position and the kerchief portion tied in the desired manner. This is particularly useful when riding in an open vehicle such a convertible, wagon, bicycle, boat or the like as well as in an infinite number of situations where a billed headcover as well as a kerchief is needed or desired.

In view of the above it is an object of the present invention to provide a combination brim and kerchief that can be folded and rolled into a compact configuration when not in use.

Another object of the present invention is to provide a baseball cap-type brim and forefront attached to a kerchief-like cloth that can be folded into a compact configuration for storage when not in use.

Another object of the present invention is to provide a billed kerchief that can be stored compactly in a small pocket or purse.

Another object of the present invention is to provide a combination kerchief, bill and forefront wherein the bill folds back juxtaposed to the forefront and the outer thirds of such members are folded back against each other and the kerchief rolled thereabout to provide a flat compact article that is readily stored in a small space when not in use.

Other objects and advantages of the present invention will become apparent and obvious from a study of the following description and the accompanying drawings which are merely illustrative of such invention.

DETAILED DESCRIPTION OF INVENTION

With further reference to the drawings, the foldable, billed kerchief of the present invention, indicated generally at 10, includes a kerchief portion, indicated generally at 11, a bill portion, indicated generally at 12, and a forefront portion, indicated generally at 13.

Figure 5:
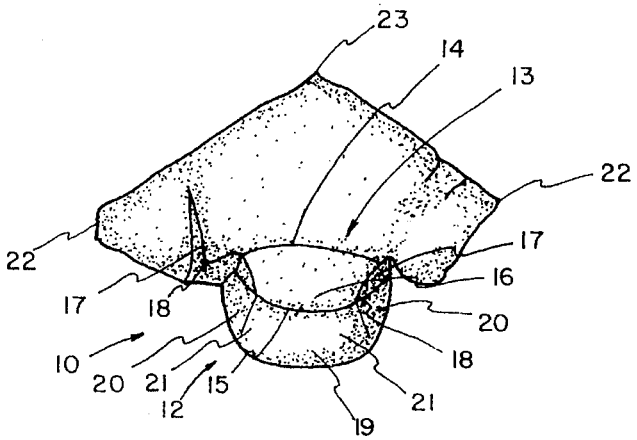
FIG. 5 is an outside perspective view of the present invention ready to be worn.
Figure 6:
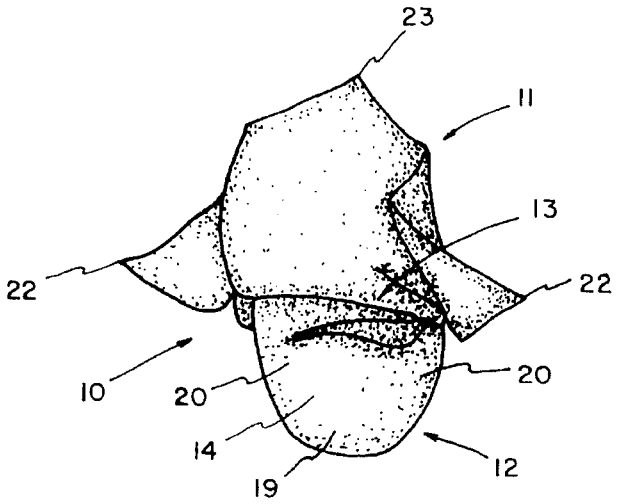
FIG. 6 is an inside perspective view of the present invention ready to be worn.

The kerchief portion 11 is generally rectangular in configuration and is secured to the upper edge of the forefront portion 13 by stitching or other suitable means as indicated at 14. This stitching is at one corner of the kerchief portion 11 as can clearly be seen in FIG. 5.

The bill portion 12 is connected to the forefront portion 13 by stitching 15 that forms a fold line between the two portions.

The forefront portion 13 has a central panel 16 and a pair of side panels 17. The central panel and side panels of the forefront are cloth covered with a stiffening means such as crinoline disposed interiorly thereof. A fold line having less stiffener or no stiffener at the juncture of the central panel and side panel creates fold lines 18. Since the use of stiffening material in bills and covering the same with cloth is well known to those skilled in the art, further detailed discussion of the same is not deemed necessary.

The bill portion 12 includes a central panel 19, and side panels 20. Where the side panels 20 meet the central panel 19 there is a weakened area to create fold lines 21. It should be noted that the positions and angles of fold lines 18 and 21 are approximately the same with the distance between such fold lines on the bill portion 12 being slightly further apart than the fold lines 18 on the forefront 13. The reason for this is, of course, to allow the respective side panels of the bill portion 12 and the forefront portion 13 to be folded over against each other as can clearly be seen in FIG. 9.

Figure 3:
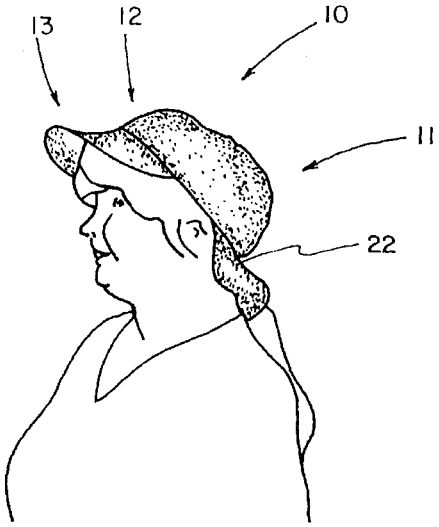
FIG. 3 is a side elevational view with the kerchief portion tied in a different manner.
Figure 8:
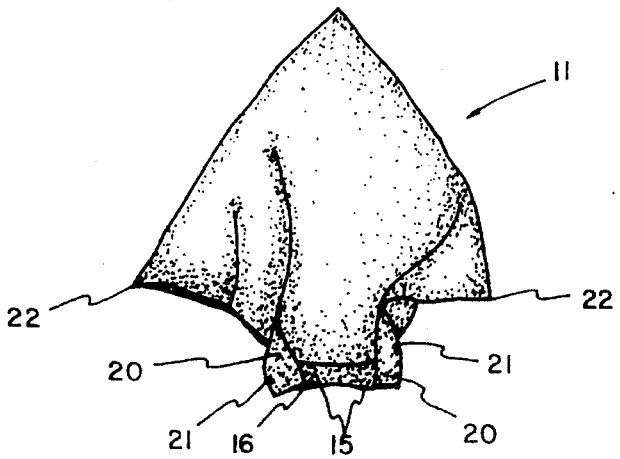
FIG. 8 is an inside elevational view of the present invention folded as set forth in FIG. 7.
Figure 9:
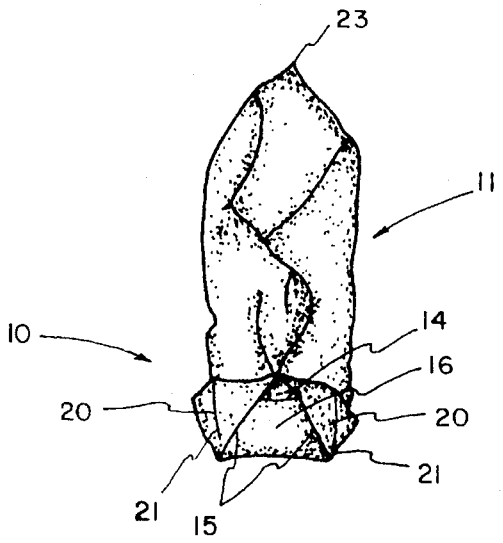
FIG. 9 is the present invention with the bill folded juxtaposed to the forefront and the outer third of such members folded back against each other.
Figure 10:
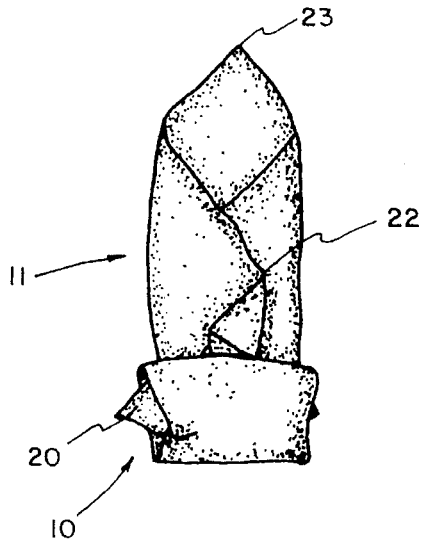
FIG. 10 shows the present invention partially rolled up.
Figure 11:
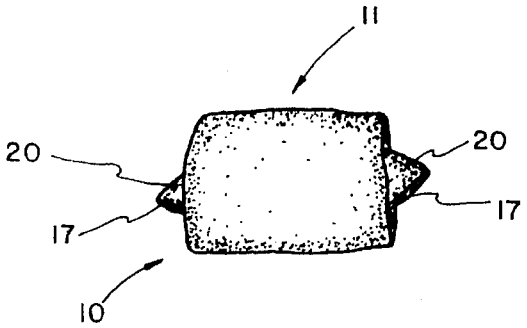
FIG. 11 shows the present invention in its storage configuration.

To use the foldable, billed kerchief 10 of the present invention, it is removed from the user's pocket, purse or other location where it has been folded as shown in FIG. 11. The kerchief portion 11 is then unrolled as shown in FIG. 10. When the unrolling is completed as shown in FIG. 9, the side corners 22 of the kerchief portion 11 are unfolded as shown in FIG. 8. The bill portion 12 is then folded away from the forefront portion 13 along fold line 15 as can clearly be seen in FIG. 7. When the brim portion 12 is folded in excess of 90 ° from the forefront portion 13 into an obtuse angle one portion to the other an can be seen in FIGS. 1 and 3, the invention of the present invention is ready to wear.

The bill portion 12 will assume a curved configuration and will protect the eyes and face of the wearer from bright lights such as sunlight or the like.

Figure 1:
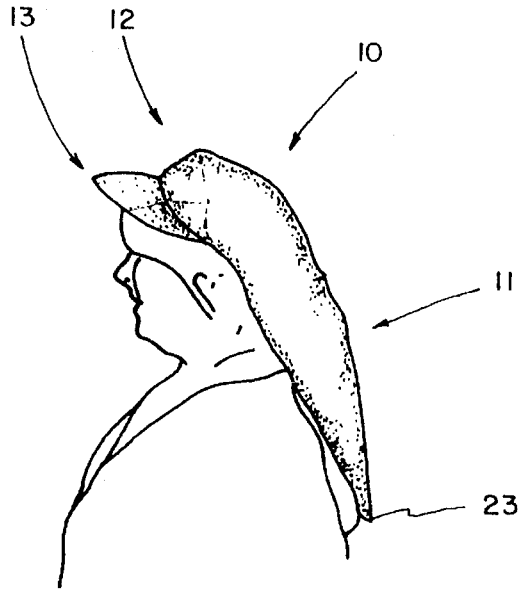
FIG. 1 is a side elevational view of the foldable, billed kerchief of the present invention being worn by a user thereof.
Figure 2:
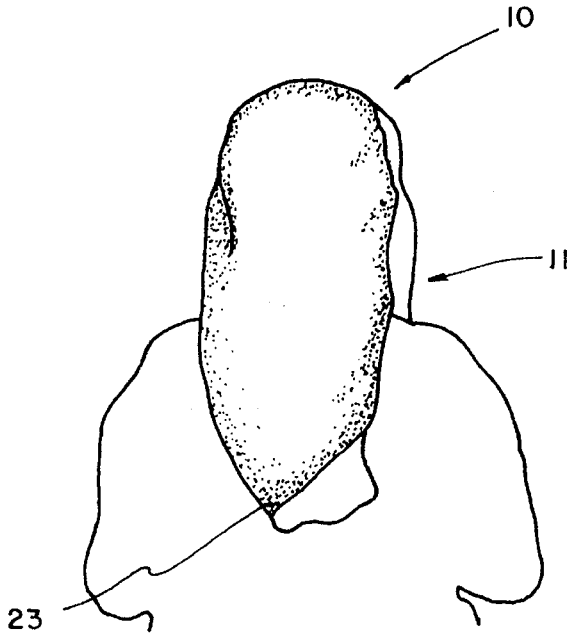
FIG. 2 is a rear elevational view.
Figure 4:
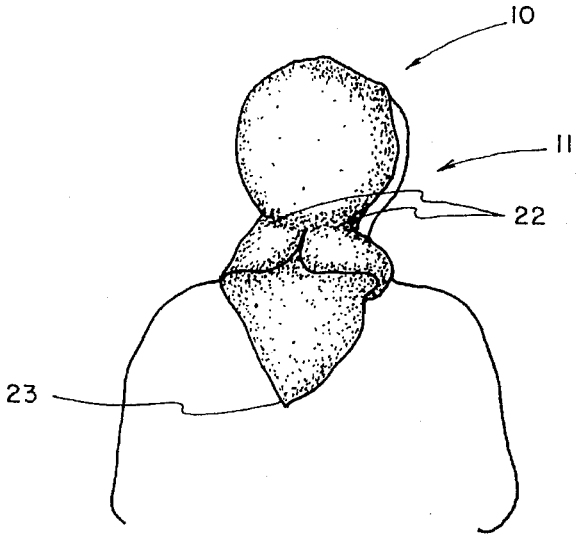
FIG. 4 is a rear elevational view thereof.

When wearing the present invention in the manner shown in FIGS. 1 and 2, it covers not only the head but the hair down the back. When worn in the fashion shown in FIGS. 3 and 4, the side corners 22 of the kerchief portion 11 are tied together. The present invention will, of course, stay on better when so tied and the lower corner 23 can even be tucked up under the tied side corners 22 for an even more compact looking head cover.

Figure 7:
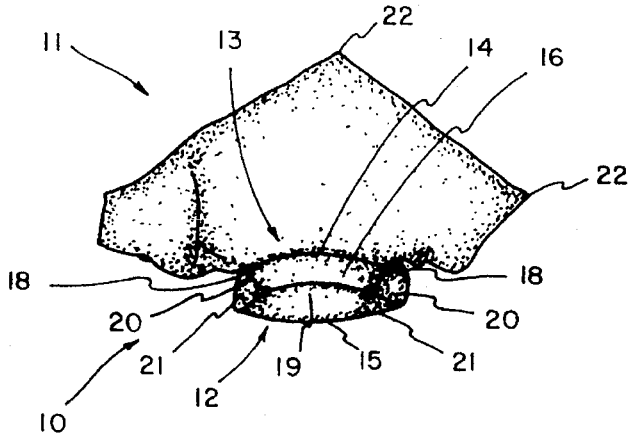
FIG. 7 is an outside elevational view with the bill portion partially folded against the forefront portion and the outer third of such member folded inwardly.

Whenever the user is through wearing the foldable, billed kerchief 10 of the present invention, it can be removed from the head of such user and the bill portion folded back against the forefront portion as shown in FIG. 7. The bill and forefront side panels are then folded back on themselves as shown in FIG. 9 and the kerchief portion 11 rolled or folded around the thus folded bill and forefront to the .compact size shown in FIG. 11 which will readily fit in a small purse or pocket until needed again.

Figure 12:
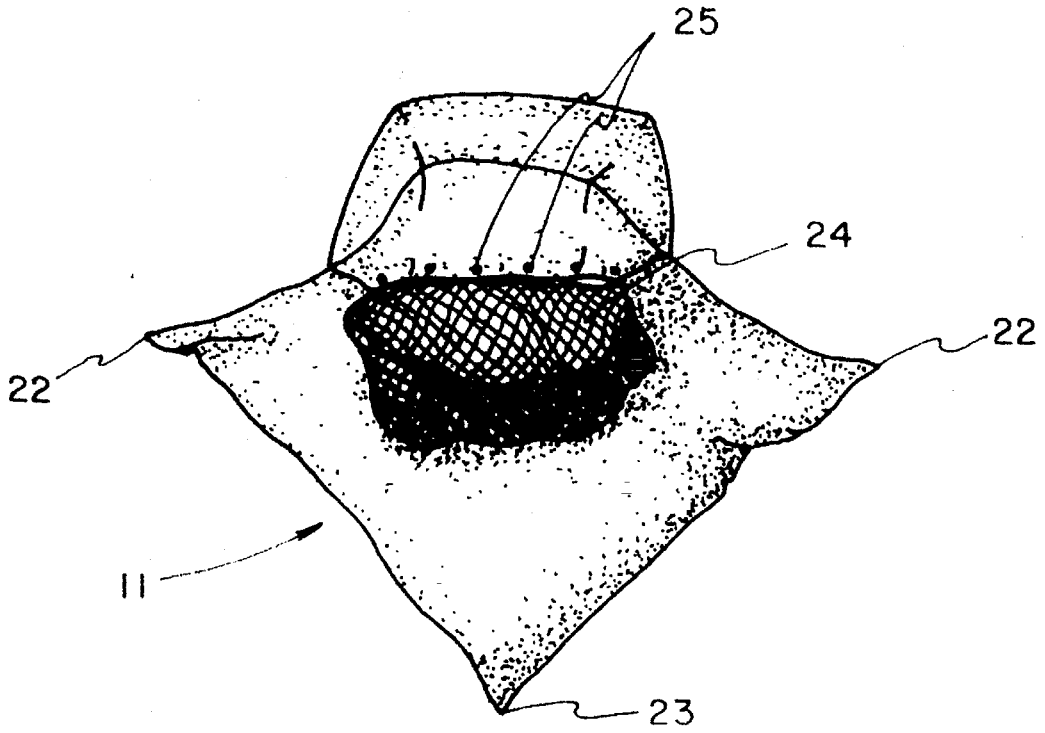
FIG. 12 is a perspective view of the present invention with a removable hair net incorporated thereinto.

In the modification shown in FIG. 12, snaps or other fastening means 25 are used to secure a hair net 24 therein. This modification can be attached to the underside of the present invention so the user's hair can be tucked into the hair net whenever it is desired. This also would be very useful for people working in food service and other environments where the hair must be covered for sanitary purposes.

From the above it can be seen that the present invention has the advantage of providing a relatively simple and yet highly-efficient head covering that can be readily folded to a compact size when not in use. It can also be readily deployed from its folded position prior to being placed on the head of the user.

The terms "side", "lower", "upper", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A foldable, billed kerchief comprising: a kerchief portion; a forefront portion attached to said kerchief portion; a bill portion attached to said forefront portion along a weakened fold line; said forefront portion and said bill portion each having a central panel and a pair of side panels wherein the central panels have side margins with the central panels being joined at each of their side margins to a said side panel along a weakened fold line whereby the bill portion can be folded into registration with the forefront portion and the side panels folded against the central panels and the kerchief portion wrapped thereabout, so that the same can be stored in a compacted state when not in use.

2. The foldable billed kerchief of claim 1 wherein said central panels and said side panels are reenforced with a relatively stiff material.

3. The foldable billed kerchief of claim 2 wherein said reenforcing material is at least one layer of crinoline.

4. The foldable billed kerchief of claim 1 wherein said kerchief portion includes a pair of side corners and a lower corner.

5. The foldable billed kerchief of claim 1 wherein said forefront portion and said billed portion are covered with the same material the kerchief portion is made of.

6. The foldable billed kerchief of claim 1 wherein a hair net is attached to the underside of such kerchief.

7. The foldable billed kerchief of claim 6 wherein the hair net is releasably attached to the kerchief.

8. The foldable billed kerchief of claim 7 wherein the releasably attaching means are snaps.

9. The foldable billed kerchief of claim 7 wherein the releasably attaching means are buttons.

* * * * *